US005328058A

United States Patent [19]

Leoncavallo et al.

[11] Patent Number: 5,328,058

[45] Date of Patent: Jul. 12, 1994

[54] DROPPER BOTTLE ASSEMBLY WITH SQUEEZE CAP

[75] Inventors: Richard A. Leoncavallo, Pittsford; Ravinder C. Mehra, Fairport; Gregory R. Phillips, Geneva, all of N.Y.

[73] Assignee: Nalge Company, Rochester, N.Y.

[21] Appl. No.: 117,628

[22] Filed: Sep. 8, 1993

Related U.S. Application Data

[63] Continuation-in-part of Ser. No. 841,840, Feb. 26, 1992, Pat. No. 5,246,145, which is a continuation of Ser. No. 804,171, Dec. 9, 1991, Pat. No. D. 338,830, which is a continuation-in-part of Ser. No. 708,442, May 31, 1991, abandoned, said Ser. No. 841,840, is a continuation-in-part of Ser. No. 708,442, May 31, 1991, which is a continuation-in-part of Ser. No. 518,465, May 3, 1990, abandoned.

[51] Int. Cl.[5] ..... B65D 47/18

[52] U.S. Cl. ..... 222/153; 215/216; 215/237; 220/338; 222/420; 222/542; 222/546; 222/556

[58] Field of Search ..... 222/153, 212, 215, 542, 222/546, 556, 568; 215/216, 237, 235; 220/334, 337, 338, 342

[56] References Cited

U.S. PATENT DOCUMENTS

| | | | |
|---|---|---|---|
| 802,760 | 10/1905 | Hovey . | |
| 898,005 | 8/1908 | Rodler . | |
| 1,182,515 | 5/1916 | Viragh . | |
| 1,662,682 | 3/1926 | Lloyd . | |
| 1,676,846 | 7/1928 | Watson | 222/546 X |
| 2,096,802 | 10/1937 | Griner | 222/546 |
| 2,249,832 | 7/1941 | Hubschman | 222/420 |
| 2,259,992 | 10/1941 | Binon | 222/215 X |
| 2,342,477 | 2/1944 | Magnenat | 220/338 |
| 2,439,985 | 4/1948 | Perelson | 222/556 |
| 2,526,458 | 10/1950 | Bronnenkant | 220/338 |
| 2,624,907 | 1/1953 | Graham | 220/338 |
| 2,659,510 | 11/1953 | Jung | 222/546 X |
| 2,663,463 | 12/1953 | Benbury et al. | 222/215 |
| 2,734,665 | 2/1956 | Flamm | 222/212 X |
| 2,765,488 | 10/1956 | Fruff | 220/338 |
| 2,765,949 | 10/1956 | Hillman | 220/338 |
| 2,833,447 | 5/1958 | Thiele | 222/556 X |
| 2,874,881 | 2/1959 | Stull | 222/421 |

(List continued on next page.)

FOREIGN PATENT DOCUMENTS

| | | | |
|---|---|---|---|
| 588244 | 12/1959 | Canada . | |
| 2366195 | 8/1979 | Fed. Rep. of Germany . | |
| 3129559 | 6/1982 | Fed. Rep. of Germany . | |
| 8535205.5 | 2/1986 | Fed. Rep. of Germany . | |
| 1014961 | 8/1952 | France . | |
| 2622795 | 5/1989 | France | 222/420 |
| 644554 | 10/1950 | United Kingdom . | |
| 1357512 | 6/1974 | United Kingdom . | |
| 2101096 | 1/1983 | United Kingdom . | |

*Primary Examiner*—Kevin P. Shaver
*Attorney, Agent, or Firm*—Wood, Herron & Evans

[57] ABSTRACT

The present invention is a dropper bottle assembly (30) with a dispensing closure (34) having a base (48) adapted to be secured to the bottle 32) and an elongated dropper spout (64) extending from the base (48) to a distal open end (72) and with a separate cap (36, 236) defining a cavity (76) sized to receive the spout (64) therein wherein the cap (36, 236) and closure (34) share cooperating hinge (80, 84) and lock structures (130, 132, 264) for pivotably mounting the cap (36, 236) about a fixed axis and locking the cap (36, 236) closed with the spout opening (72) closed off. The lock (130) and hinge (84) structure are formed on the spout (64) below the opening (72) thereof but spaced from the closure base (48). The lock mechanism includes a lock arm (134) on the closure spout and a lock edge (132,264) at or near the distal end (134) of a front wall portion or tab (136, 244) extending from the cap top with zones of flexibility (160, 240, 242) defined by side slots (160) or thinned-out hinge segments (240, 242) to allow the distal edge (134) to flex away from the lock arm (134) when the cap (36, 236) sides (164, 250) are squeezed to facilitate opening the cap. The spout is sealed by a surface (170) of the cap or a compliant mat (174) on that surface, the latter being held in place by one or more ribs (178, 252) within the cap (36, 236).

41 Claims, 7 Drawing Sheets

U.S. PATENT DOCUMENTS

| | | | |
|---|---|---|---|
| 2,889,087 | 6/1959 | Paull et al. | 222/556 X |
| 2,950,847 | 8/1960 | Tupper | 222/556 X |
| 2,987,223 | 6/1961 | Armour | 222/420 |
| 3,045,860 | 7/1962 | Desgagne | 220/338 |
| 3,054,535 | 9/1962 | Clarey | 222/215 |
| 3,077,282 | 2/1963 | Eggers | 220/338 |
| 3,243,838 | 4/1966 | Blumberg | 220/338 X |
| 3,285,256 | 11/1966 | Despard . | |
| 3,307,752 | 3/1967 | Anderson . | |
| 3,317,274 | 5/1967 | McCormick . | |
| 3,394,835 | 7/1968 | Peterson | 220/337 |
| 3,497,908 | 3/1970 | Zamarra | 220/338 X |
| 3,515,314 | 6/1970 | Waterman . | |
| 3,603,470 | 9/1971 | Armour | 215/213 |
| 3,604,585 | 9/1971 | Towns | 215/216 X |
| 3,703,975 | 11/1972 | Wittemer | 215/216 X |
| 3,710,989 | 1/1973 | Armour | 222/562 |
| 3,754,639 | 8/1973 | Gellert . | |
| 3,765,578 | 10/1973 | Stull | 222/546 |
| 3,768,707 | 10/1973 | Nigro . | |
| 3,802,607 | 4/1974 | Mead | 222/182 |
| 3,884,396 | 5/1975 | Gordon et al. | 222/327 |
| 3,927,805 | 12/1975 | Stull | 222/153 |
| 3,984,028 | 10/1976 | Zinnbauer | 220/338 |
| 4,002,275 | 1/1977 | Crowle et al. | 222/543 |
| 4,022,352 | 5/1977 | Pehr | 222/153 |
| 4,047,495 | 9/1977 | O'Brian . | |
| 4,087,028 | 5/1978 | Lang . | |
| 4,109,821 | 8/1978 | Lutz | 220/337 |
| 4,124,151 | 11/1978 | Hazard | 222/556 X |
| 4,127,221 | 11/1978 | Vere | 222/153 |
| 4,146,146 | 3/1979 | Mar | 215/213 |
| 4,158,902 | 6/1979 | Chernack et al. | 220/335 |
| 4,172,540 | 10/1979 | Erichson | 215/235 X |
| 4,193,164 | 3/1980 | Okayama | 220/335 X |
| 4,204,615 | 5/1980 | McCarthy | 222/153 |
| 4,209,100 | 6/1980 | Uhlig | 215/216 |
| 4,209,114 | 6/1980 | Wilson et al. | 222/556 X |
| 4,220,248 | 9/1980 | Wilson et al. | 215/235 |
| 4,220,253 | 9/1980 | Thomas et al. | 220/338 |
| 4,220,262 | 9/1980 | Uhlig et al. | 222/153 |
| 4,234,103 | 11/1980 | Strobl, Jr. etal. | 222/420 X |
| 4,236,653 | 12/1980 | Gach | 222/153 |
| 4,257,537 | 3/1981 | Uhlig | 222/153 |
| 4,257,561 | 3/1981 | McKinney | 222/153 X |
| 4,310,105 | 1/1982 | Gach | 222/153 |
| 4,353,483 | 10/1982 | Pehr | 222/153 |
| 4,377,248 | 3/1983 | Stull | 222/546 |
| 4,378,066 | 3/1983 | Sato et al. . | |
| 4,383,618 | 5/1983 | Dougherty | 215/216 |
| 4,387,819 | 6/1983 | Corsette | 222/546 |
| 4,444,326 | 4/1984 | Musel . | |
| 4,467,931 | 8/1984 | Gach | 215/237 |
| 4,513,888 | 4/1985 | Curry | 222/153 |
| 4,527,690 | 7/1985 | Schmidts et al. . | |
| 4,533,058 | 8/1985 | Uhlig | 222/153 X |
| 4,540,090 | 9/1985 | Gelardi et al. | 220/338 X |
| 4,546,894 | 10/1985 | Suinat et al. . | |
| 4,579,239 | 4/1986 | Hart | 215/216 X |
| 4,588,097 | 5/1986 | Hauser | 215/216 |
| 4,625,898 | 12/1986 | Hazard | 222/517 |
| 4,629,081 | 11/1986 | McLaren | 222/153 X |
| 4,640,428 | 2/1987 | Chang . | |
| 4,646,916 | 3/1987 | Ishida et al. . | |
| 4,658,547 | 4/1987 | Oboza . | |
| 4,666,036 | 5/1987 | Bourbon | 220/338 X |
| 4,666,068 | 5/1987 | Bush | 222/556 |
| 4,696,408 | 9/1987 | Dubach | 215/237 |
| 4,699,283 | 10/1987 | Dubach | 215/237 |
| 4,706,813 | 11/1987 | Schneider et al. | 220/338 X |
| 4,711,360 | 12/1987 | Ullman | 222/546 X |
| 4,717,050 | 1/1988 | Wright | 222/545 X |
| 4,718,567 | 1/1988 | LaVange | 222/153 X |
| 4,723,669 | 2/1988 | Barriac | 215/216 X |
| 4,726,484 | 2/1988 | Lutz | 215/329 |
| 4,727,999 | 3/1988 | Gach | 215/235 X |
| 4,739,906 | 4/1988 | LoTurco | 222/153 |
| 4,742,928 | 5/1988 | Braun | 222/556 X |
| 4,747,498 | 5/1988 | Gach | 215/235 X |
| 4,749,108 | 6/1988 | Dornbusch et al. | 222/556 X |
| 4,759,455 | 7/1988 | Wilson | 222/153 X |
| 4,776,475 | 10/1988 | LaVange | 215/216 |
| 4,782,964 | 11/1988 | Poore et al. | 215/216 |
| 4,787,526 | 11/1988 | Pehr | 215/216 |
| 4,790,442 | 12/1988 | Gach | 222/153 |
| 4,793,484 | 12/1988 | Schoettle | 220/335 X |
| 4,807,781 | 2/1989 | Bobinger et al. | 222/546 |
| 4,809,874 | 3/1989 | Pehr | 215/237 X |
| 4,821,898 | 4/1989 | Smalley | 215/216 |
| 4,821,899 | 4/1989 | Nycz et al. | 215/235 |
| 4,838,441 | 6/1989 | Chernack | 222/153 X |
| 4,858,776 | 8/1989 | Mehra | 215/220 |
| 4,887,747 | 12/1989 | Ostrowsky et al. | 222/556 |
| 4,892,208 | 1/1990 | Sledge | 215/216 |
| 4,925,041 | 5/1990 | Pehr | 215/216 |
| 4,993,606 | 2/1991 | Bolen, Jr. et al. | 222/546 |
| 5,002,206 | 3/1991 | Allegretti et al. | 222/420 X |
| 5,038,957 | 8/1991 | Gross | 215/235 X |
| 5,048,715 | 8/1991 | Wolff | 220/335 |
| 5,065,876 | 11/1991 | Joyce | 222/556 X |
| 5,092,493 | 3/1992 | Pehr | 222/153 |
| 5,121,859 | 6/1992 | Stull | 222/546 X |
| 5,141,138 | 8/1992 | Odet et al. | 222/556 X |
| 5,246,145 | 9/1993 | Leoncavallo et al. | 222/153 |

DROPPER BOTTLE ASSEMBLY WITH SQUEEZE CAP

RELATED APPLICATIONS

This application is a continuation-in-part of our U.S. application Ser. No. 07/841,840 filed Feb. 26, 1992, now U.S. Pat. No. 5,246,145, which is (i) a continuation-in-part of our U.S. application Ser. No. 07/708,442, filed May 31, 1991 (now abandoned), which is a continuation-in-part of our U.S. application Ser. No. 07/518,465, filed May 3, 1990 (now abandoned), all entitled "Dropper Bottle Assembly" and (ii) a continuation of our U.S. application Ser. No. 07/804,171 filed Dec. 9, 1991, now U.S. Pat. No. 338,830, entitled "Dropper Nozzle and Cover Assembly" which is a continuation-in-part of the aforementioned application Ser. No. 07/708,442. The disclosures of all four of the aforementioned applications are incorporated herein by reference.

BACKGROUND OF THE INVENTION

I. Field of the Invention

The present invention is directed to a dropper bottle assembly used to dispense liquids.

II. Description of the Prior Art

Dropper bottle assemblies are used to dispense a variety of liquids, typically one drop at a time. For example, dropper bottle assemblies are used for the dispensing of liquid reagents in laboratories, dispensing eye medication, dispensing ear medication, or in any other environment where dispensing of a liquid in controlled drop increments is desired.

One typical prior art dropper bottle assembly comprises a plastic bottle, a nozzle or spout section which is press fit onto the bottle and a cap which is threaded onto the bottle. Liquid is dispensed one drop at a time by squeezing the bottle so as to force liquid out the end or tip of the nozzle. Due to the construction of the bottle assembly, leakage is a problem during dispensing. An additional problem with this type bottle construction is that filling of the bottle by the liquid manufacturer requires a two-step assembly process. After the bottle is filled with the appropriate liquid to be dispensed, the nozzle must first be press fit onto the bottle and the cap then threaded onto the bottle. This two-step assembly process typically requires expensive capping equipment.

Another typical prior art dispensing bottle assembly comprises a plastic bottle, a dispensing plastic nozzle threaded onto the neck of the bottle, and a cap threaded onto the nozzle. With this type of bottle assembly, the cap must thread down over the nozzle far enough for the top inner surface of the cap to engage the top of the dropper spout in order to seal the spout against leakage. Mismatch in parts, and over or under tightening of the cap, may result in an inadequate seal and leakage.

Additionally, a serious problem with both types of prior art dropper bottle assemblies is contamination of the liquid to be dispensed. In many instances, such as in laboratories and research centers, a variety of different liquid reagents may be used together. Typically, these reagents are quite expensive and extremely sensitive to contamination. The caps of the bottles are typically taken completely off and placed on a bench during use and are later returned to their respective bottles. The possibility exists that the cap will be replaced on the wrong bottle, thus resulting in cross contamination between different reagents. If recognized, these reagents should be discarded. However, if the user fails to recognize this cross contamination, the continued use of such reagents could result in faulty test results. In addition to cross contamination, great care must be taken to avoid contamination of the cap or the nozzle that may be caused by the fingers of the user or by the surface upon which the cap is placed. In some instances, the user will attempt to hold the cap in his hand while also holding the bottle. This makes dispensing of a liquid cumbersome and presents the possibility of dropping the cap which can also result in contamination.

SUMMARY OF THE INVENTION

Applicants have invented an improved dropper bottle assembly which minimizes or eliminates many of the problems of prior art dropper bottle assemblies. A nozzle or dispensing closure has a base portion matable to the bottle and an elongated spout extending from the top wall of the base portion. A cap is pivotably mounted to the closure to pivot over the spout and surround the spout when the cap is closed. The cap and dispensing closure have cooperating locking mechanisms to hold the cap in sealing relationship with the dropper spout. In accordance with the present invention, the locking mechanism of the closure is situated on the exterior of the spout rather than within the spout or on the base portion of the closure. Further in accordance with the present invention, the locking mechanism of the cap is defined by a front wall portion of the cap extending from the top of the cap with a lock edge formed on the front wall portion such as adjacent the distal end of the front wall portion. The front wall portion is defined between zones of flexibility formed in the cap side wall and positioned such that pressure on the cap side wall causes the front wall portion to flex outwardly from the cap. The zones of flexibility may be defined by thinned-out hinge segments in the cap or by slots to either side of the front wall portion. Thus, as the cap is pivoted closed, the distal end of the front wall portion slides over the closure lock mechanism and locks thereto. To open the cap, pressure on the sides of the cap flexes the front wall portion such that the distal end and the associated lock edge come away from the closure allowing the cap to be pivoted open.

The dispensing closure and mounted cap may be supplied to the liquid manufacturer pre-assembled allowing for one step capping. Additionally, the assembly is easily opened by squeezing the cap to disengage the locking mechanism and pivoting the cap over the spout. In this way, the cap is held to the nozzle thus minimizing potential contamination while also permitting simple one hand dispensing.

In accordance with one aspect of the present invention, the locking mechanism on the closure is a lock arm designed to engage the front wall portion lock edge as the cap is pivoted to the closed position and to disengage when the front wall portion flexes due to force applied to the cap sides so as to allow pivoting of the cap to the open position without otherwise twisting or rotating the cap. The two locking elements have angled mating and ramp surfaces to facilitate closing and unlocking as desired.

In accordance with another aspect of the invention, the dispensing closure supports a hinge mechanism to the side of the spout above the top wall of the dispensing closure to define a pivot axis for the cap which is spaced above the top of the bottle but which allows the cap to pivot over the spout without interference from the portion of the dispensing closure which mates with the neck of the bottle. In accordance with a further aspect of the present invention, the cap is pivotably mounted to the dispensing disclosure by a pair of opposed hinge pins on the cap and a yoke on the dispensing disclosure, or vice versa. The opposed hinge pins have a gap therebetween through which the yoke may be received upon spreading apart the hinge pins to mount the cap to the dispensing closure. To facilitate such mounting, the opposed surfaces of the hinge pins are cammed, or angled, in preferably opposite directions, so as to provide a surface against which the yoke will bear as the cap is pressed onto the dispensing closure to allow for snap-fitting of the cap to the dispensing closure. The hinge pins extend from opposed surfaces of the cap or dispensing closure and are urged towards one another to fit into the yoke until the opposed surfaces supporting the hinge pins meet up with the yoke. These surfaces preferably frictionally engage the planar sidewalls of the yoke to assist in holding the cap in any position of its pivot from closed to fully open.

The angle of the hinge pin cammed surfaces advantageously defines an ever widening gap from the top to the bottom of the hinge pins as a result of which a maximum bearing surface is provided against the yoke when the cap is closed, while also providing a minimum interface between the hinge pins and the yoke in the fully open position of the cap. As a consequence, the cap will be held securely to the dispensing closure in the closed position, but may be readily snapped off from the closure in the fully open position. To this end, in those instances where temporary removal of the cap may be desired, camming action between the hinge pins and the yoke in the fully open position of the cap allows for removal of the cap with reduced likelihood of destruction of the hinge mechanism so that the cap may be reapplied for subsequent use.

To facilitate use of the assembly, the cap is advantageously relieved above its hinge section so that as the cap is pivoted into the open position, the cap will not impinge against the top of the dispensing closure until the cap is fully open such as at 180 degrees. The relieved area of the cap defines a ledge which cooperates with the dispensing closure in the fully open position of the cap to provide a fulcrum for snapping the cap from the dispensing closure as the cap is pivoted past the fully open position.

In accordance with a still further aspect of the present invention, the locking mechanism and hinge assembly are preferably positioned, when the cap is in the closed and locked position, to opposite sides of the spout. Consequently, with the top inner surface of the cap, or any compliant mat or liner therealong, resting against the top of the spout, the lock mechanism exerts a force which translates to a force on the hinge mechanism which places the hinge pins in shear against the yoke. Further, the top inner surface of the cap (or the associated liner) will be compressed against the spout opening and seal off that opening.

In accordance with an even further aspect of the present invention, the inner surface of the top of the cap is provided with a seal structure to seat against the spout opening for a better seal. To this end, the seal may be comprised of a fixed or flexible projection on the cap top inner surface which projection seats against the spout opening when the cap is closed. A compliant liner or mat may be placed against the cap top inner surface, overlying the projection, for a better sealing action on the spout. Alternatively, the projection on the cap may be dispensed with, and the compliant mat, with or without its own hemispherical projection, may be utilized. The compliant mat is held in place against the inside top of the cap by one or two longitudinal ribs which frictionally engage edges of the mat. The ribs extend downwardly through the cap to sit astride the spout when the cap is closed. The extended ribs provide protection against lateral shifting of the cap whereby to reduce the likelihood of the cap becoming unlocked due to lateral loading against the cap such as might occur during shipment.

By virtue of the foregoing, there is thus provided a dropper bottle assembly which reduces or eliminates leakage, assembly, and contamination problems encountered with prior art dropper bottle assemblies. These and other objects and advantages of the present invention shall become more apparent from a detailed description of the invention.

BRIEF DESCRIPTION OF THE DRAWINGS

The accompanying drawings, which are incorporated in and constitute a part of this specification, illustrate the invention and, together with the general description of the invention given above and the detailed description given below, serve to explain the principles of the invention.

DETAILED DESCRIPTION OF THE DRAWINGS

Figures 1, 2, 3:
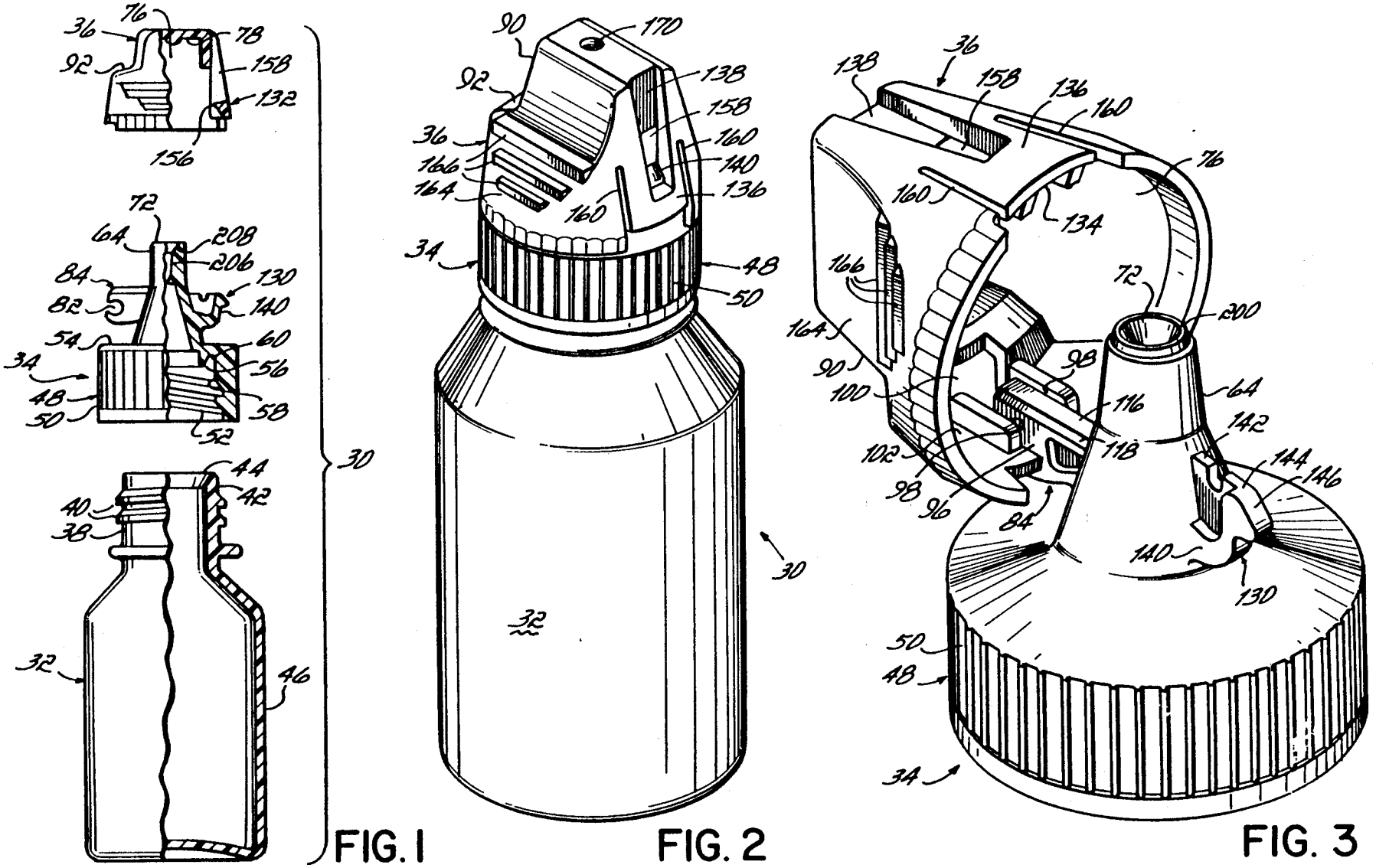
FIG. 1 is an exploded front elevational view, partially in cross-section, of a dropper bottle assembly in accordance with the principles of the present invention.
FIG. 2 is a perspective view of the assembled dropper bottle assembly of FIG. 1 with the cap in the closed position.
FIG. 3 is a perspective view of the assembled cap and dispensing closure of the dropper bottle assembly of FIG. 1 with the cap positioned between the fully opened and the closed positions.

With reference to the Figures, an example of a bottle assembly 30 constructed in accordance with the principles of the present invention will be described, it being understood that other arrangements and configurations are within the scope of the invention. Dropper bottle assembly 30 includes a bottle 32, a dispensing closure or nozzle 34, and a cap 36 as will be described. Bottle 32 is preferably of molded plastic and is designed to hold liquid to be dispensed, such as reagents used in laboratories and research facilities by way of example. Bottle 32 includes a neck portion 38 having external threads 40 and an outer rim 42 which defines an outlet 44 of the bottle 32, although bottle 32 may take any desired configuration as is typical for such bottles. Bottle 32 may be made of a low density polyethylene such as CHEVRON 5104, although it will be appreciated that bottle 32 may be made out of any suitable plastic material such as high density polyethylene, PVC, PETG, or PET (stretch blow). It is understood that the bottle material should be compatible with the liquid to be contained therein and that sidewall 46 of bottle 32 preferably be capable of being deflected so as to cause liquid to be dispensed therefrom.

Dispensing closure 34 is designed to mate with neck portion 38 of bottle 32. To this end, base portion 48 of dispensing closure 34 includes an annular skirt 50 having internal threads 52 threadably engaging external threads 40 of bottle neck portion 38. Depending from the top wall 54 of the closure base portion 48 and disposed within annular skirt 50 is an annular sealing ring 56 spaced from the internal surface 58 of skirt 50. Sealing ring 56 is sized, shaped and spaced to provide an annular recess 60 to receive the rim 42 of bottle 32 and provide a seal between closure 34 and bottle 32. Affixed to and extending vertically upwardly from the base portion top wall 54 of dispensing closure 34 is an elongated dispensing section or spout 64 which is in fluid communication with outlet 44 of bottle 32 when assembled (as in FIG. 4). Spout 64 includes a dispensing passageway 66 therethrough with a distal open end 72 for allowing liquid within bottle 32 to pass out of dispensing closure 34 in drops.

Figure 4:
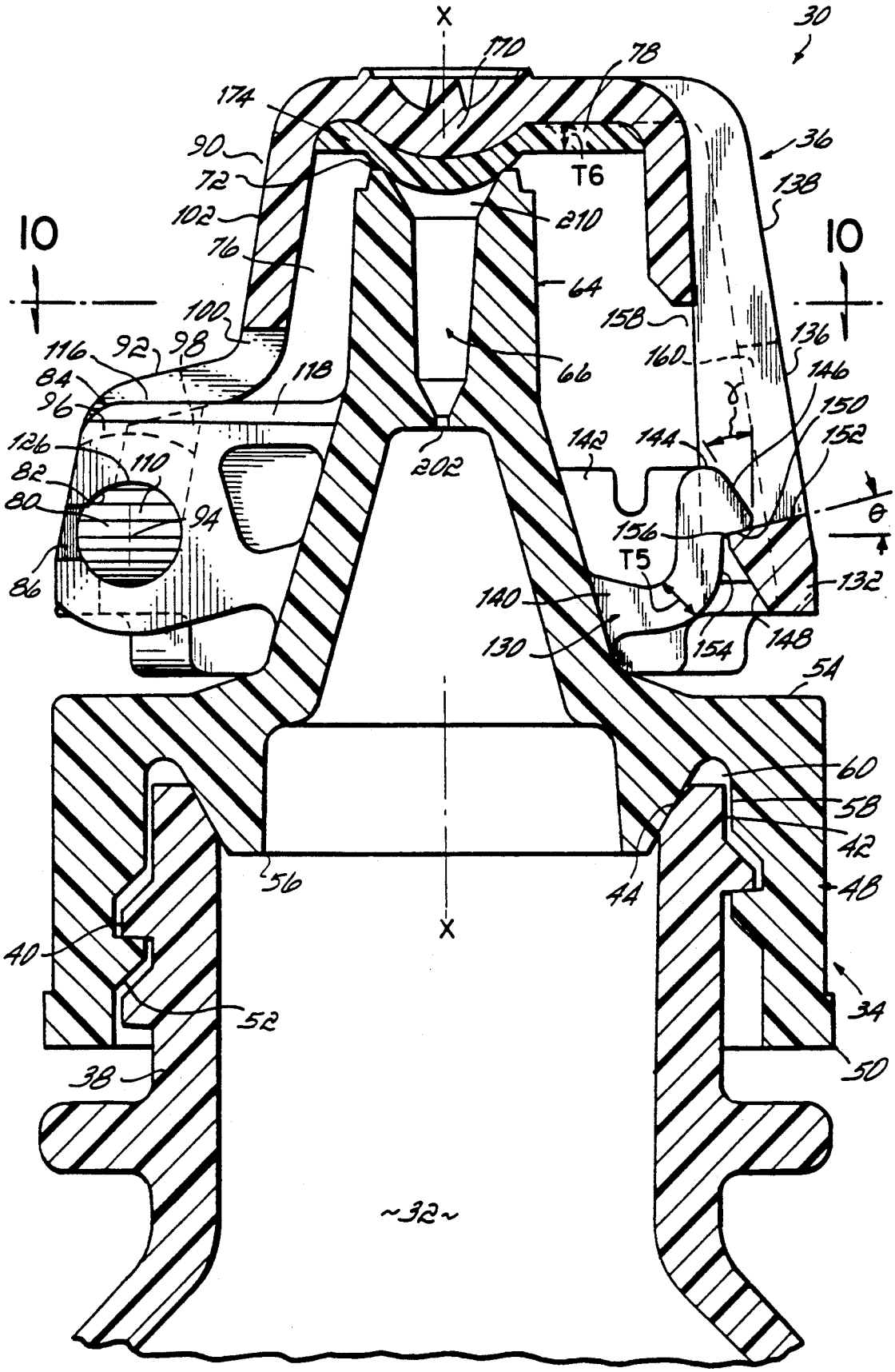
FIG. 4 is a cross-sectional view of the assembled dropper bottle assembly of FIG. 1 with the cap in the closed position.
Figure 5:
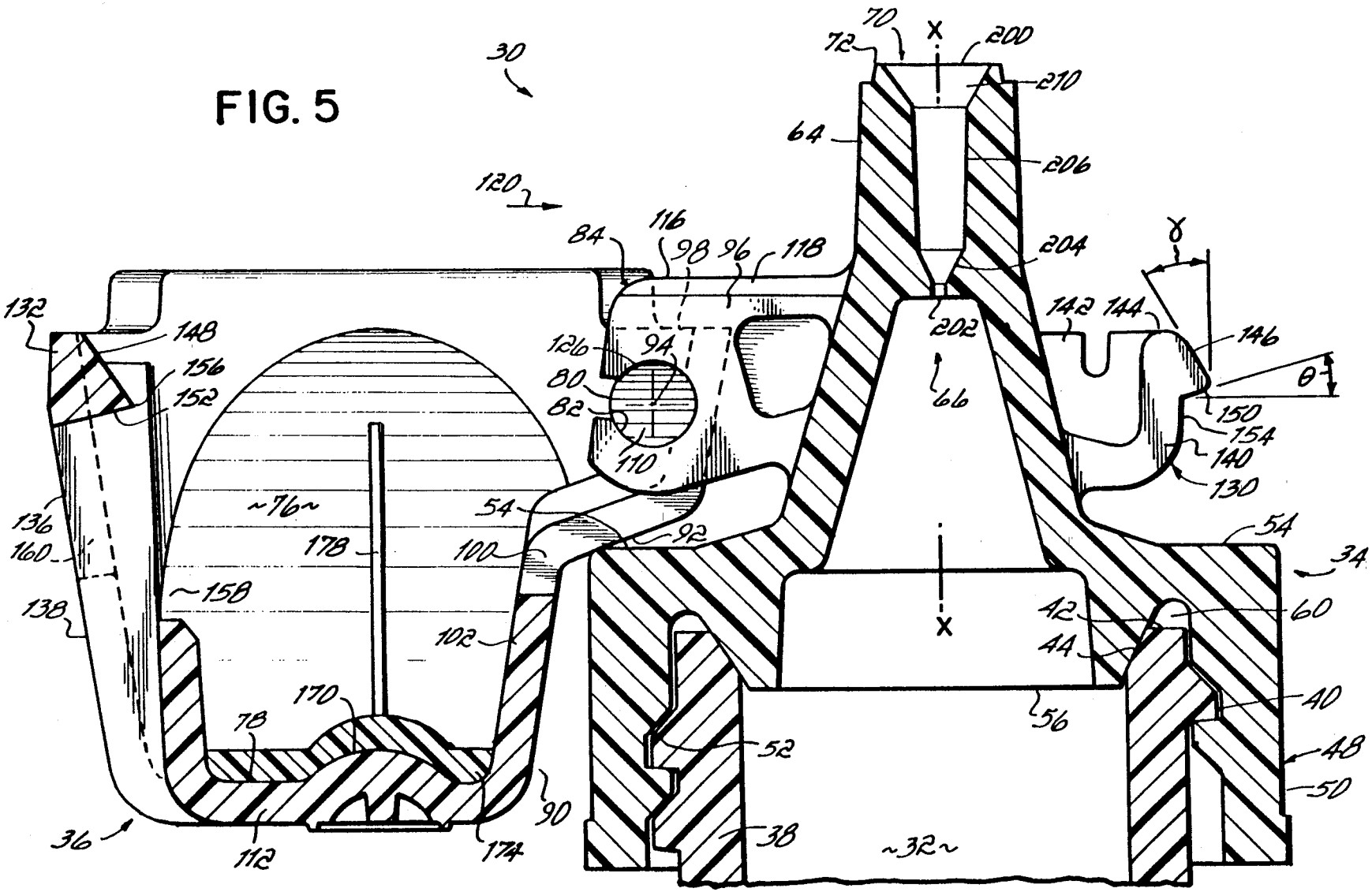
FIG. 5 is a view similar to FIG. 4 with the cap in the fully opened position.
Figure 6:
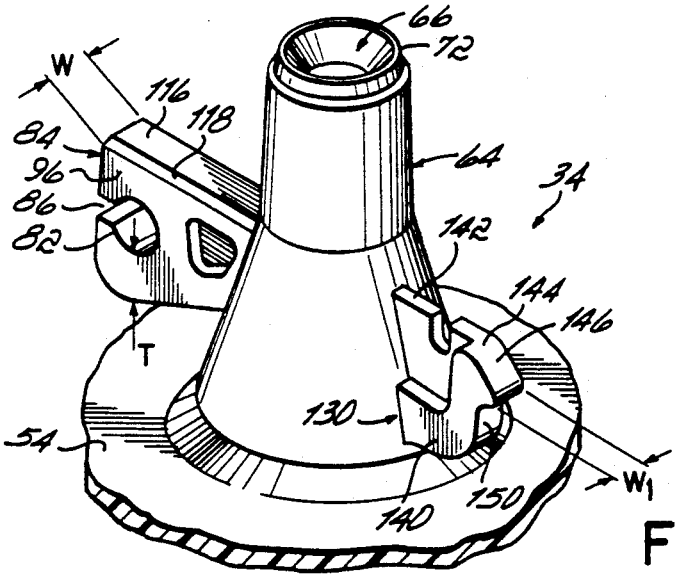
FIG. 6 is a partial perspective view of the dispensing closure of the dropper bottle assembly of FIG. 1.

Molded plastic closure cap 36 is a separate piece from, but is pivotably mounted to, plastic dispensing closure 34 to be pivoted about a fixed axis between a closed and locked position as seen in FIG. 4 and a fully open dispensing position as seen in FIG. 5 for dispensing liquid from bottle 32. Cap 36 defines an inner cavity or space 76 into which spout 64 is received as cap 36 is pivoted to the closed position (see FIG. 3). In that closed position (See FIG. 4), spout 64 is surrounded by cap 36 with a seal defined at the top inner surface 78 of cap 36 in sealing engagement (directly or via a projection and/or a compliant mat as will be described) with tip end 72 of spout 64.

Cap 36 is pivotably mounted to dispensing closure 34 by a hinge mechanism such as defined by a pair of axially aligned substantially cylindrically shaped projections or hinge pins 80 molded in cap 36 and which rotate in circular opening 82 formed in retaining member or yoke 84 which is integrally molded as part of closure 32. Yoke member 84 may completely enclose the periphery of opening 82 or may be substantially C-shaped with a portion cut away as at 86 to confine yoke member 84 within cylinder 88 defined by the outer periphery of nozzle skirt 50 (FIG. 8) such that with cap 36 attached thereto and in the closed position, cap 36 is also substantially confined within cylinder 88. To facilitate pivoting of cap 36 a full 180 degrees to the open position, cap 36 is relieved as at 90 to define a ledge 92 which rests adjacent top wall 54 of dispensing closure 34 when cap 36 is fully open as seen in FIG. 5. Yoke member 84 is designed to be substantially rigid so as to resist any substantial deformation that may result from cap 36 being placed in the closed position. Member 84 has a width W, thickness T, and a configuration designed so that it can be integrally molded as part of closure 34. The opening 82 in member 84 is preferably slightly larger than the diameter of projections 80 to allow cap 36 to thereby pivot about fixed axis 94 along the longitudinal axes of projections 80.

Sidewalls 96 of yoke 84 are substantially planar and are frictionally engaged by the opposed sidewalls 98 of cap 36 which support projections 80 in the area of cap cutaway 100 (along back side wall 102 of cap 36) to permit cap 36 to be positioned at any position along its path of pivot between open and closed (see, e.g., FIG. 3). Moreover, sidewalls 98 bear against sidewalls 96 of yoke 84 in any position of the cap to thereby limit wobble of cap 36 as it is opened and closed. It will be understood, however, that alternative locking structure may be provided to maintain the cap in the open dispensing position, for example, through the use of indexing projections (not shown) between cap 36 and dispensing closure 34 or to allow positive positioning of cap 36 in any position along its path of rotation.

Figure 7:
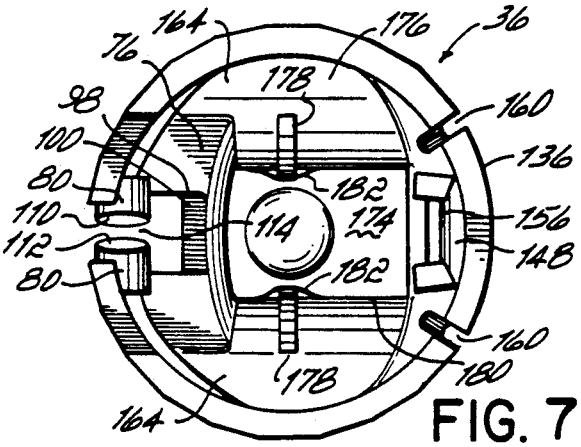
FIG. 7 is a bottom plan view of the dispensing closure of FIG. 1.
Figure 8:
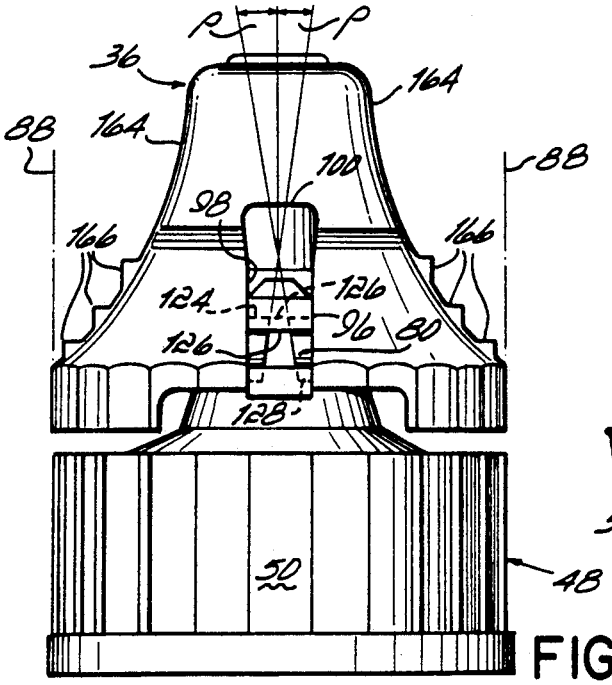
FIG. 8 is a left side elevational view of the dispensing closure and cap of FIG. 1.

Hinge pins 80 include cammed surfaces 110 and 112 (see FIGS. 7 and 8) to facilitate use and assembly. More specifically, cammed surfaces 111 and 112 are oppositely angled at an angle $\rho$ (FIG. 8) with respect to a plane through the longitudinal axis X—X of spout 64, which angle is preferably about 10°, to define a gap 114 which is ever widening from the top to the bottom of the hinge pins as seen in FIG. 8. With sidewalls 98 normally being spaced apart about 0.085 inches (2.16 mm), and pins 80 being about 0.090 inches (2.29 mm) in diameter, gap 114 ranges in width from about 0.030 inches (0.76 mm) to about 0.060 inches (1.52 mm).

Cap 36 may be snapped onto dispensing closure 34 from the top (into the closed position) by camming action between yoke member 84 and hinge pins 80. The top side edge 116 of yoke 84 may also be bevelled as at 118 to further facilitate this mode of assembly. Similarly, cap 36 may be snap fit to yoke 84 in the fully opened position of cap 36 by laterally driving hinge pins 80 into opening 82 in the direction of arrow 120 in FIG. 5. Cap 36 is thus easily captured on closure 34, avoiding the necessity of completely removing cap 36 and preventing contamination thereof while also allowing easy use of the bottle during dispensing.

Angling cammed surfaces 110, 112 to define downwardly opening gap 114 also provides additional advantages both in maintaining cap 36 closed and sealingly locked against spout 64 and in facilitating non-destructive removal of cap 36 when that is desired. To this end, and with reference to FIGS. 8 and 9, with cap 36 in the closed position, each upper, larger surface 124 of hinge pins 80 provides a maximum bearing surface (about 0.028 inches (0.71 mm) laterally) against the inner top of surface 126 of yoke 84 within opening 82 when pins 80 are under shear to securely hold cap 36 to closure 34.

Figure 9:
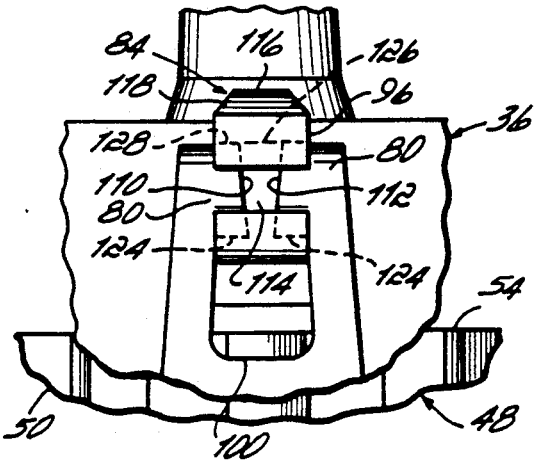
FIG. 9 is a partial left side elevational view of the open dropper bottle assembly of FIG. 5.

Yet, in the open position of cap 36, as seen in FIG. 9, each lower, short surface 128 (about 0.014 inches (0.36 mm) laterally) of pins 80 now face the inner top surface 126 of yoke 84 to provide a minimum interference therebetween to facilitate non-destructively snapping-off cap 36 from nozzle 34. To this end, ledge 92 in the relieved area 90 of cap 36 bears against top wall 54 of closure 34 with cap 36 in the open position as shown in FIG. 5 such that further pivoting of cap 36 beyond the 180° open position creates a fulcrum-like action to facilitate snapping pins 80 from yoke 84. After use, cap 36 may then be resecured to closure 34 as described above.

To secure cap 36 in the closed position, a cooperating locking mechanism is provided on cap 36 and dispensing closure 34 comprising a locking element 130 extending from and integrally formed at the base of spout 64 and a lock edge 132 on cap 36 formed along the interior distal end 134 of front wall portion or tab 136 extending downwardly from cap top wall 78 in the front side wall 138 of cap 36. Lock edge 132 is designed to engage locking element 130 as cap 36 is pivoted to the closed position.

Locking element 130 has a generally J-shaped arm portion 140 with a rigidizing web 142. Arm portion 140 extends radially from spout 64 such that its top or end section 144 functions much like a tooth to engage lock edge 132 as edge 132 passes thereover. To this end, top section 144 has an upper cam face or ramp surface 146 over which complimentary ramp surface 148 of lock edge 132 rides when closing cap 36. Top section 144 also has a lower surface 150 designed to mate and engage with upper surface 152 of lock edge 132 to hold cap 36 locked in the closed position. Arm portion 140 is further shaped such that when cap 36 is in the closed position, side surface 154 of arm portion 140 is adjacent and in substantial contact with surface 156 of lock edge 132 with a portion of top section 144 seated within opening 158 in the front wall 138 of cap 36.

Tab 136 is defined by zones of flexibility such as 0.25 inch (6.35 mm) long vertical slots 160 defining an approximately 60° span therebetween in the front face of cap 36 so that tab 136 is sufficiently flexible to deflect a sufficient distance such that its lock edge 132 can engage and disengage locking element 130. Thus, as cap 36 is pivoted closed, ramp surface 148 of lock edge 132 slides over ramp surface 146 of locking element 130 and distends or flexes tab 136 outwardly of cap 36 until lock edge 132 passes beyond end section 144 at which time tab 136 returns to its normal position with lock edge 132 secured against locking element 130 as previously described. To release cap 36 from the locked position, the user (not shown) applies pressure against the left and right side walls 164 of cap 36 such as by applying finger pressure to ridges 166 on surfaces 164. That pressure will push front wall 138 outwardly and flex tab 136 outwardly thereby releasing lock edge 132 from locking element 130 at which time cap 36 may be pivoted open.

Figure 10:
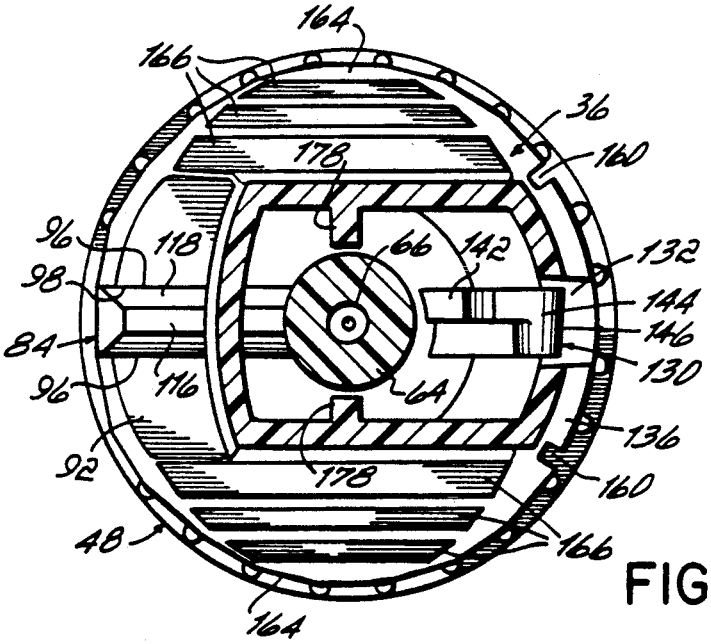
FIG. 10 is a cross-sectional view taken along line 10—10 of FIG. 4.

In order to seal spout 64 with cap 36, there is provided a generally hemispherical dome shaped projection 170 depending from cap top inner surface 78 into cavity 76 of the cap and positioned in alignment with opening 72 of spout 64. A thin liner or mat 174 of a relatively compliant material is placed against the inner top surface 78 of cap 36 overlying projection 170. A bulge forms on compliant mat 174 in the area of projection 170 (alternatively mat 174 could have a bulge formed thereon and projection 170 dispensed with) such that the mat tends to conform to opening 70 to thereby assist in providing improved sealing engagement of spout 64 and minimize or prevent leakage therefrom. Mat 174 may be secured against top inner surface 78 by adhesive or the like although a purely mechanical friction fit is desirable. To this end, as seen in FIG. 7, rectangular mat 174 is sized to fit within the space adjacent cap top inner surface 78. Molded into curved sidewalls 164 and inner surface 176 of cap 36 in the area of surface 78 is at least one and desirably a pair of opposed ribs 178 which extend slightly into cavity 76 of cap 36 and towards mat 174. As a consequence, when mat 174 is pushed against inner surface 78 its lateral edges 180 will compress against ribs 178 as at 182 to thereby frictionally hold mat 174 in place. Ribs 178 also extend downwardly from surface 78 into cavity 76 so as to sit astride spout 64 in the closed position of cap 36 (see FIG. 10) to thereby minimize the possibility of lateral shifting of cap 36 which might otherwise cause lock edge 132 and locking element 130 to disengage. Ribs 178 are, however, sufficiently spaced from spout 64 that generally simultaneous compression of cap sidewalls 64 will cause tab 136 to flex thereby releasing lock edge 132 from locking element 130.

Figure 11:
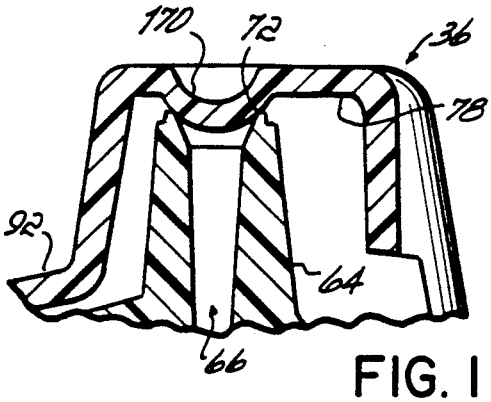
FIG. 11 is a cross-sectional view of an alternative seal for the cap of FIG. 1.
Figure 12:
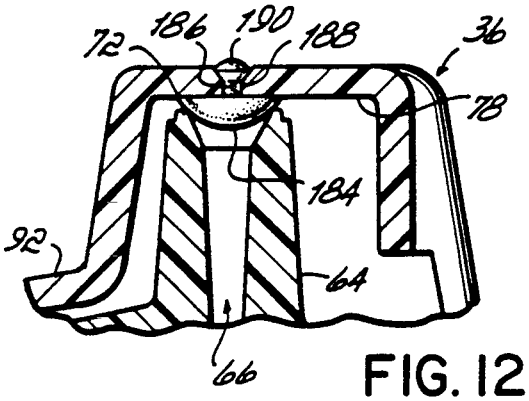
FIG. 12 is a cross-sectional view of a further alternative seal for the cap of FIG. 1.

Mat 174 may be dispensed with and the seal provided by hemispherial or dome-shaped projection 170 alone as seen in FIG. 12. Alternatively, as shown in FIG. 11, top surface projection 170 and mat 174 may be replaced with flexible projection 184 having an elongated retainer section 186 which is press fit into an opening 188 provided in top surface 78 of cap 36. The other end 190 of projection 184 has a substantially spherical shape so as to assist in retaining projection 184 onto cap 36. Elastomeric or rubber projection 184 may alternatively be secured to cap 36 in other ways such as by use of an adhesive or other mechanical locking arrangement.

Figure 13:
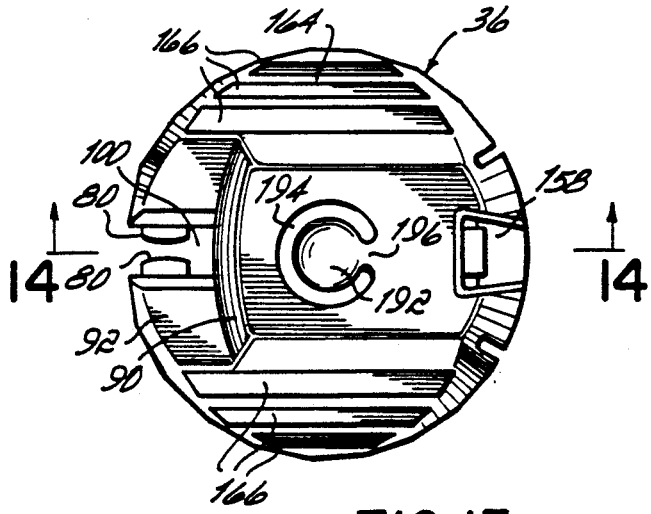
FIG. 13 is a top plan view of the cap of FIG. 1 illustrating an even further alternative seal for the cap.
Figure 14:
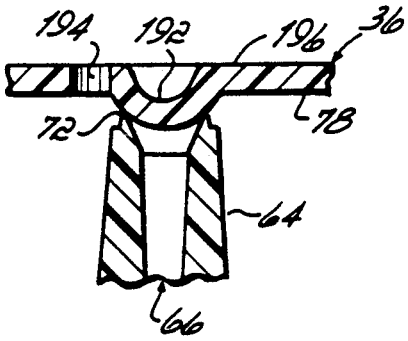
FIG. 14 is a cross sectional view as taken along line 14—14 of FIG. 13.

Referring to FIGS. 13 and 14 there is illustrated yet another alternative seal comprised of a molded-in flexible projection 192 in cap 36 with an opening 194 extending around projection 192 so as to form a flexible connecting portion or tab 196. Opening 194 may extend about 300° around projection 192. When cap 36 is in the closed and locked position, the flexible nature of projection 192 allows it to seat within spout tip 72 in sealing engagement therewith.

With cap 36 closed and locked, locking element 130 bears downwardly on lock edge 132 to urge cap top 78 and mat 174 (or other sealing structure on cap top 78) against spout 64 thereby sealing off spout outlet 72. Additionally, the force from locking element 130 on lock edge 132 is translated to hinge pins 80 placing them under shear against yoke 84 as desired. As may be appreciated from the Figures, the fixed pivot axis 94 of cap 36 and the locking location along surface 146 are on diametrically opposed sides of spout 64 thus minimizing eccentric loading and providing good loading characteristics to seal spout 64.

Mating surfaces 150 and 152 of the closure locking element and lock edge, respectively, are disposed at respective angles $\phi$ with respect to a line perpendicular to the longitudinal axis X—X of the spout which is also the longitudinal axis of the bottle and the cap. Closure 34 is made of polypropylene (which may be gamma resilient) or other suitable plastic. Alternatively, closure 34 could be made of high density polyethylene, polycarbonate, PETG, PCTG, polysulfone or polyether imide. Cap 36 is made of $CaCO_3$ filled polypropylene (which may be gamma resilient) or other suitable plastic material.

With the above-mentioned materials, a tight seal on spout 64 is maintained while also allowing cap 36 to be easily disengaged from closure 34 with an angle $\phi$ greater than 0° but less than about 15° preferably in the range of about 5° to 10°. Similarly, ramp surfaces 146, 148 are at an angle $\gamma$ with respect to longitudinal axis X—X of spout 64. Stiffness of the locking element 130 and lock edge 132 drive the size of angle $\gamma$ with the angle decreasing as those materials get stiffer. However, to reduce criticality to the amount of overlap of the two surfaces when they first meet, a larger angle $\gamma$ is desired. Preferably, $\gamma$ is in the range of about 30° to about 35° and, more specifically, for locking element 130 is about 30° and for lock edge 132 is about 35° with the present materials.

Locking element arm portion 140 is illustrated as having a cross section T5 ranging from about 0.035 inches to 0.055 inches (0.889 mm to 1.397 mm) and a width WI of about 0.090 inches (2.286 mm). Also, mat 174 is made out of low density polyethylene (such as CHEVRON 5104) or ethylene vinyl acetate or EVA (with between 2 and 30% or about 12% vinyl acetate content) and has a thickness T6 in the range of about 0.020 to 0.040 inches (0.508 to 1.016 mm) and preferably is about 0.030 inches (0.762 mm) thick. Further, the portions of the hinge mechanism and locking structure which are formed on closure 34 are at the base of spout 64 to provide ease of assembly with maximum pivotability to open and close over spout 64, but they are not directly integral with (i.e., they are spaced above) closure top wall 54 so as not to create sink marks in closure 34 which might adversely affect the seal between bottle 36 and closure 34.

Figure 15:
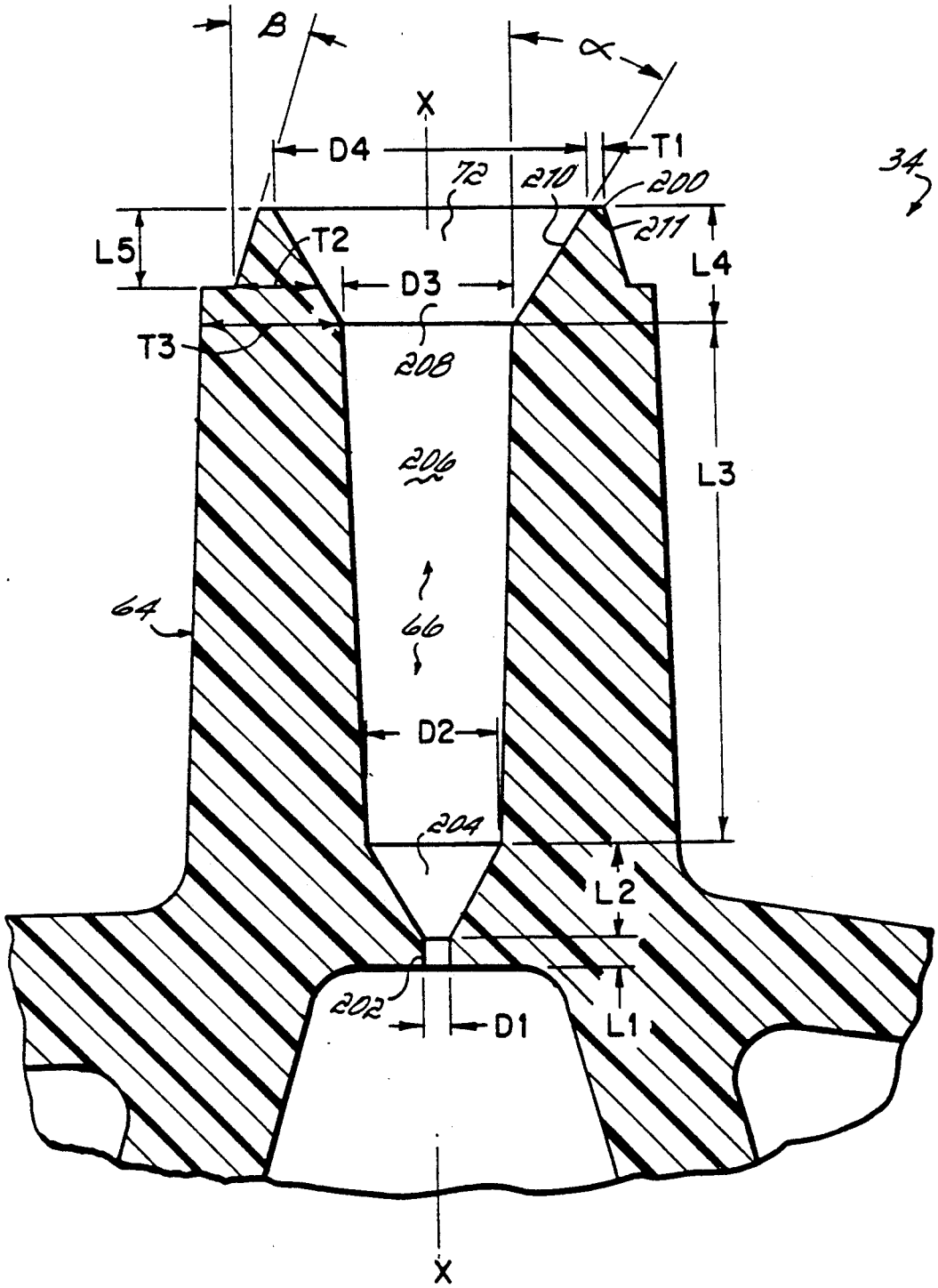
FIG. 15 is an enlarged cross-sectional view of the spout of the dispensing closure of FIG. 1.

Spout 64 has a dispensing passageway advantageously designed for a dropper function. To this end, and with reference to FIG. 15, there is illustrated an enlarged partial cross-sectional view of dispensing closure 34 in which the details of liquid passageway 66 may be seen. More specifically, outer tip 200 adjacent outlet 72 has been configured so as to provide desired compliance for better sealing relationship with the seal 170 in cap 36 when cap 36 is placed in the closed position. Further, dispensing passageway 66 comprises four discrete sections which assist in accurately controlling of the dispensing of individual drops. Passageway 66 has an inner section 202 having a diameter D1, and length L1, wherein L1 is about 0.010 inches (0.254 cm) and D1 is about 0.010 inches (0.254 cm). Adjacent inner section 202 is first conical transition section 204 which increases to a diameter D2 and has a length L2, wherein diameter D2 is about 0.047 inches (0.110 cm) and L2 is about 0.032 inches (0.0813 cm). Adjacent outer end of conical transition section 204 is disposed a second conical section 206 which has a diameter D2 at its outer end and a length L3. A fourth, outer section 208 is disposed adjacent second conical section 206 to form outlet 72 having a diameter D4. D3 is about 0.060 inches (0.152 cm), L3 is about 0.184 inches (0.467 cm), D4 is about 0.110 inches (0.279 cm), and L4 is about 0.043 inches (0.109 cm). It is, of course, understood that the above dimensions may be varied as desired. Section 208 has a conical surface 210 which forms an angle $\alpha$ with respect to the longitudinal axis X—X of passageway 66 wherein angle $\alpha$ is about 30°. While angle $\alpha$ may be varied as desired, it is preferably no more than about 45°. Tip 200 adjacent outlet 72 has a thickness T1 and an outer surface 211 disposed at an angle $\beta$ so that tip 200 increases to a thickness T2 at a length L5. T1 is about 0.005 inches (0.0127 cm), T2 is about 0.042 inches (0.1067 cm) and L5 is about 0.030 inches (0.0762 cm). The values for T1, T2, and L3 are selected such that tip 200 is sufficiently compliant so as to conform generally to the sealing projection in cap 36 whereby to assist in providing a liquid tight seal therebetween. The thickness of closure 34 goes to T3 at the lower end of tip 200 so as to provide the desired rigidity for the remaining portion of closure 34 wherein T3 is about 0.049 inches (0.229 cm), although a different thickness may be employed as desired to provide the degree of rigidity desired. The material selection will, of course, also affect the selection of T1, T2, and L3 to obtain the desired compliance. Closure 34 may be made of high density polyethylene.

Figure 16:
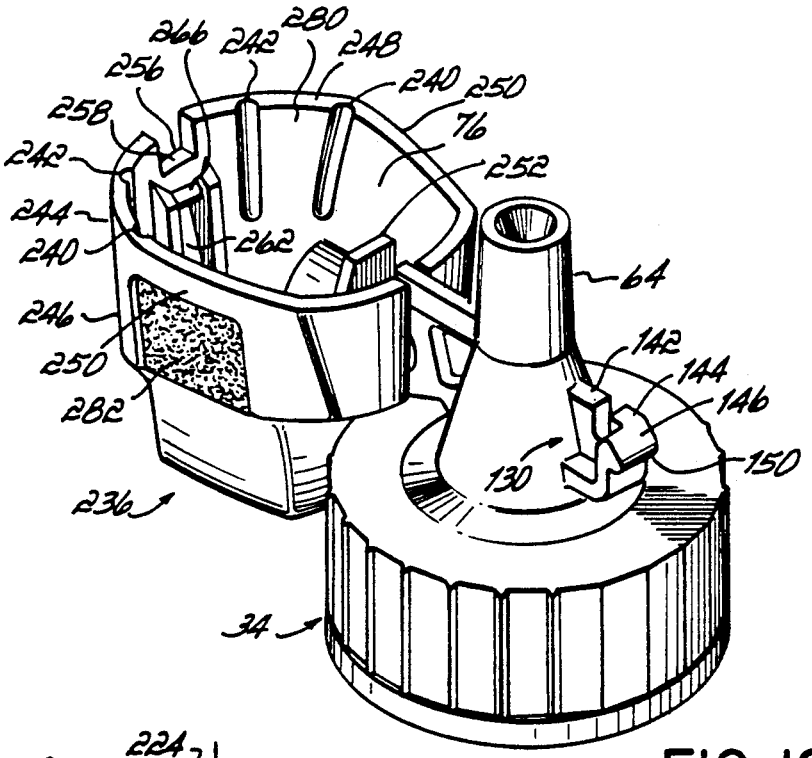
FIG. 16 is a perspective view of an alternative embodiment of a cap for use in the dropper bottle assembly of FIG. 1 shown on the dispensing closure of FIG. 1.
Figure 17:
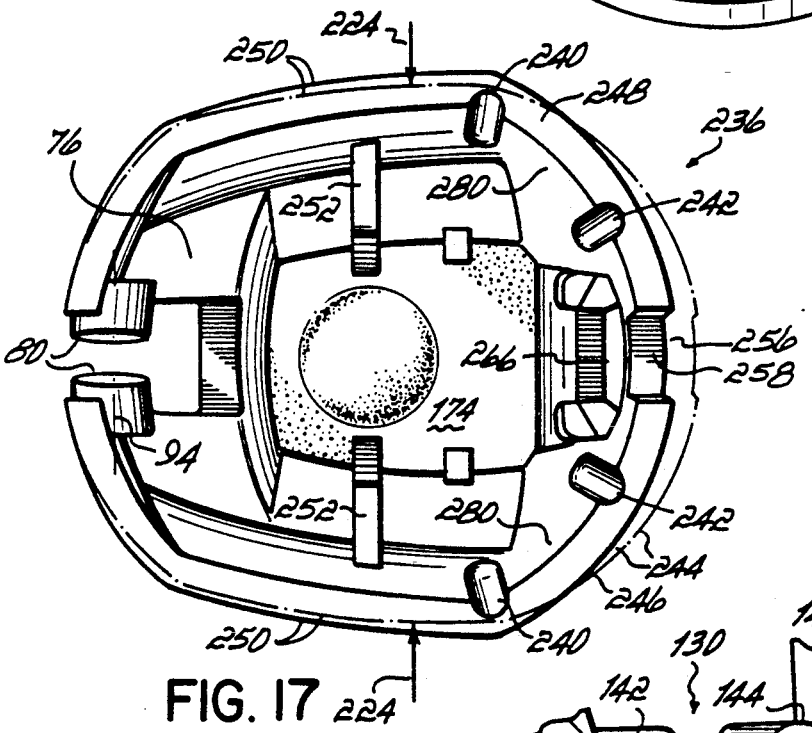
FIG. 17 is a bottom plan view of the cap of FIG. 16.
Figure 18:
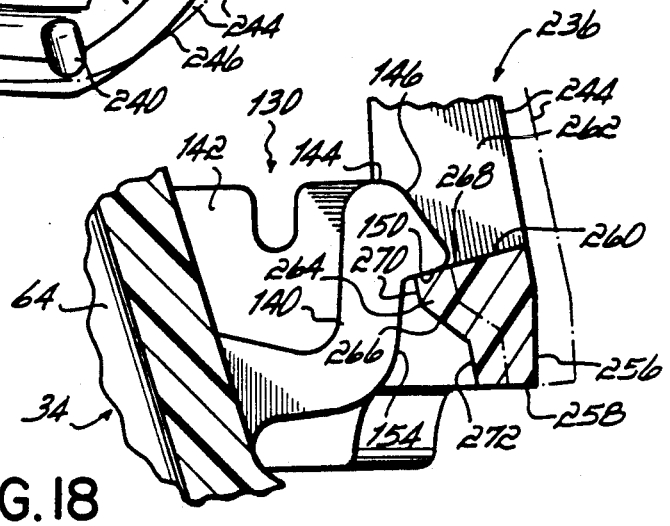
FIG. 18 is a cross-sectional view showing the cap and closure of FIG. 16 in the closed position.

The cap may be modified to include zones of flexibility which do not break through the outer surface of the cap as do slots 160. To this end, as seen in FIGS. 16–18, an alternative embodiment of a cap 236 for bottle assembly 32 is shown with zones of flexibility defined by thinned-out hinge segments 240, 242. A pair of hinge segments 240, 242 is formed to either side of front wall portion 244 of cap 236. Hinge segments 240, 242 extend into the cap from the interior or cavity 76 thereof to define an approximate 0.02 inch (about 0.51 mm) radius without interrupting the exterior surface 246 of the cap walls, which are otherwise closer to 0.04 inch (about 1.02 mm) thick. Hinge segments 240, 242 extend vertically from the bottom peripheral edge 248 of cap 236 upwardly about 0.23 inch (5.84 mm). Rearward hinges 240 are formed in sidewalls 250 of cap 236 spaced forwardly of ribs 252 about 0.137 inch (3.48 mm). Forward hinges 242 are spaced forward of ribs 252 about 0.259 inch (6.58 mm).

Front wall portion 244 includes a 0.07 inch (1.78 mm) tall locking element 256 defined between peripheral bottom edge portion 258 (spaced about 0.06 inch (1.52 mm) above cap edge 248) and lower ledge 260 of aperture 262. Formed at the upper end of locking element 256 is an inwardly directed lock edge 264 having a lower ramp surface 266 to mate with and ride over surface 146 of top section 144 of locking element 130. To this end, ramp surface 266 is angled at about 55° with respect to a line perpendicular to the longitudinal axis of the bottle and the cap (or about 35° relative to that axis). Lock edge 264 further includes an upper edge 268 at an angle of between about 5° and 15°, or preferably about 10° with respect to a line perpendicular to the bottle and cap longitudinal axis to mate and engage with the lower surface 150 of arm portion 140 with a portion of the top end 144 of arm portion 140 seated within aperture 262 in the front wall portion 244. Lock edge 264 terminates in a side surface 270 that is about .013 inch (0.33 mm) tall and spaced inwardly about 0.01–0.015 inch (0.25–0.38 mm) from the interior surface 272 of front wall portion 244.

When pressure is applied to cap side walls 250 in the direction of arrows 224 of FIG. 17, cap 236 flexes along hinge segments 240, 242 to allow three panels to move (side panels 280 between each hinge pair 240, 242 and front wall portion 244) such that front wall portion 244 distends (as shown in phantom in FIGS. 17 and 18) and lock edge 264 releases from locking element 130. Cap 236 may then be pivoted open. Cap 236 is otherwise like cap 36 except that (i) instead of ridges 166, cap side walls 250 are not arcuate and instead have a textured surface as at 282 to facilitate squeezing and pivoting of the cap and (ii) each of ribs 252 has an approximately 15° taper along its lower distal half.

In use of bottle assembly 30, cap 36 (or cap 236, as desired) is secured to closure 34 for pivoting about fixed pivot axis 94 with hinge pins 80 rotating snugly within yoke 84. Cap 36 (or 236) may be locked closed with mat 174 sealing spout 64. To open the cap, finger pressure is applied to cap sidewall surfaces 164 (or 250) against roughened area 166 (or 282) which causes the cap to flex and lock edge 132 (or 264) to disengage from locking element 130 whereupon the cap may be pivoted to the open position with spout 64 fully exposed for dispensing drops of fluid. The cap is, however, held to closure 34 during dispensing to avoid contamination. The cap may be over-pivoted to snap-off if desired and later snapped back onto closure 34. After use, the cap is then pivoted closed such that lock edge 132 (or 264) and locking element 130 cooperate to again lock the cap closed in sealing engagement with spout 64.

While the present invention has been illustrated by the description of alternative embodiments, and while the embodiments have been described in considerable detail, it is not the intention of the applicants to restrict or in any way limit the scope of the appended claims to such detail. Additional advantages and modifications will readily appear to those skilled in the art. For example, yoke 84 and hinge pins 80, or locking element 130 and lock edge 132 (or 264), could be interchanged between closure 34 and cap 36 (or 236). The invention in its broader aspects is therefore not limited to the specific details, representative apparatus and method and illustrative examples shown and described. Accordingly, departures may be made from such details without departing from the scope or spirit of applicants' general inventive concept.

Having described the invention, what is claimed is:

1. A dropper bottle assembly comprising:

a bottle;

a dispensing closure having a base adapted to be secured to the bottle, the dispensing closure further having an elongated dropper spout extending from the base to a distal spout opening;

a squeeze cap having side and front wall portions defining a cavity sized to receive the spout therein, the cap being hinged to the closure with the cap being pivotable between a closed position wherein the spout is within the cap cavity and an open position wherein the spout opening is exposed;

a seal associated with the cap for closing off the spout opening in the closed position of the cap;

a first locking element on the closure;

a second locking element associated with the cap front wall portion, the first and second locking elements being positioned to lockingly engage one another as the cap pivots from the open to the closed position; and zones of flexibility formed in at least the cap side wall portions and positioned relative the front wall portion such that pressure on the cap side wall portions causes the front wall portion to flex outwardly of the cap to release the first and second locking elements from one another so as to allow the cap to pivot to the open position.

2. The dropper bottle assembly of claim 1, the zones of flexibility being defined by slots formed in the cap to either side of the front wall portion.

3. The dropper bottle assembly of claim 2 wherein the first locking element is carried by the spout but spaced from the spout opening, the second locking element including a lock edge defined along a distal edge of the front wall portion between the slots.

4. The dropper bottle assembly of claim 1, the zones of flexibility being defined by thinned-out hinge segments formed in at least the cap side wall portions to either side of the front wall portion.

5. The dropper bottle assembly of claim 4 wherein the hinge segments extend into the cap from the cavity without interrupting the exterior surface of the cap.

6. The dropper bottle assembly of claim 4 further comprising two pairs of hinges segments, one pair to each side of the front wall portion.

7. The dropper bottle assembly of claim 4 wherein the hinge segments each extend vertically along the cap.

8. The dropper bottle assembly of claim 4 wherein the first locking element is carried by the spout but spaced from the spout opening, the second locking element including a lock edge defined along a distal edge of the front wall portion between the hinge segments.

9. The dropper bottle assembly of claim 1, the first locking element being carried by the spout but spaced away from the spout opening.

10. The dropper bottle assembly of claim 9 wherein the cap has a peripheral bottom edge defined along the wall portions, the second locking element being formed adjacent the cap peripheral bottom edge.

11. The dropper bottle assembly of claim 10 wherein the front wall portion of the cap includes an aperture spaced above the second locking element and positioned to receive a portion of the first locking element therein in the closed position of the cap.

12. The dropper bottle assembly of claim 1 further comprising a roughened surface on the cap side wall portions to facilitate finger gripping and squeezing of the cap side wall portions to apply pressure thereto and cause the locking elements to release.

13. The dropper bottle assembly of claim 12, the roughened surface being defined by ribs formed on the cap side wall portions.

14. The dropper bottle assembly of claim 1, the second locking element including a lock edge defined along a distal edge of the front wall portion between the zones of flexibility.

15. The dropper bottle assembly of claim 1, the second locking element including a lock edge defined above a distal edge of the front wall portion between the zones of flexibility.

16. The dropper bottle assembly of claim 1, the first locking element having a top section with a mating surface for locking engagement with the second locking element and being positioned to deflect the second locking element and then lock into engagement with the second locking element when the cap is pivoted into the closed position whereby to secure the pivotably mounted cap in the closed position.

17. The dropper bottle assembly of claim 16, the second locking element having a mating surface for locking engagement with the first locking element top section mating surface, the mating surfaces being disposed at first and second angles, respectively, with respect to a plane perpendicular to the longitudinal axis of the spout.

18. The dropper bottle assembly of claim 17, the first and second angles each being between about 0° and about 15°.

19. The dropper bottle assembly of claim 17, the first and second angles each being about 10°.

20. The dropper bottle assembly of claim 16, the first and second locking elements each having a respective ramp surface, the ramp surfaces being positioned such that the first locking element deflects the second locking element by overlapping contact between the ramp surfaces as the cap is pivoted into the closed position.

21. The dropper bottle assembly of claim 20, each of the ramp surfaces being inclined at a respective angles in the range of about 30° to about 35° with respect to the longitudinal axis of the spout.

22. The dropper bottle assembly of claim 16, wherein the front wall portion includes an aperture spaced above the second locking element positioned to receive a portion of the first locking element top section therein in the closed position of the cap.

23. The dropper bottle assembly of claim 1 wherein the cap has a top wall, the seal being an inner surface portion of the cap top wall which sealingly engages the spout opening in the closed position of the cap.

24. The dropper bottle assembly of claim 23, the inner surface portion being a projection formed in the cap top wall.

25. The dropper bottle assembly of claim 1 wherein the cap has a top wall, the seal including a projection depending from the cap top wall and protruding into the cavity to sealingly engage the spout opening in the closed position of the cap.

26. The dropper bottle assembly of claim 25 wherein an opening is provided in the cap top wall around a portion of the projection whereby the projection may flex.

27. The dropper bottle assembly of claim 25 wherein the projection is a separate piece mounted to the cap top wall.

28. The dropper bottle assembly of claim 1, the seal including a compliant mat held in the cap cavity and positioned to sealingly engage the spout opening in the closed position of the cap.

29. The dropper bottle assembly of claim 28, the cap including at least one rib extending into the cavity and frictionally engaging an edge of the compliant mat such as to hold the mat in the cavity.

30. The dropper bottle assembly of claim 29 further comprising:

a second rib in the cap cavity spaced from the first rib and in engagement with a second edge of the compliant mat.

31. The dropper bottle assembly of claim 30, the ribs extending through the cavity such as to sit adjacent the spout to minimize lateral shift of the cap in the closed position.

32. The dropper bottle assembly of claim 28 wherein the cap has a top wall, the mat being positioned against an inner surface of the cap top wall and overlying the spout opening in the closed position of the cap, the seal further including a projection bulging from the mat to enhance sealing of the spout opening.

33. The dropper bottle assembly of claim 1, the cap including at least one rib extending into the cavity and positioned to sit adjacent the spout to minimize lateral shifting of the cap in the closed position of the cap.

34. The dropper bottle assembly of claim 1 wherein the cap is separate and non-integral with the dispensing closure, the cap and closure being hinged by at least one hinge pin and a projecting yoke formed on respective ones of the closure and the cap, the hinge pin being snugly received in an opening formed in the yoke.

35. The dropper bottle assembly of claim 34 having a pair of substantially axially aligned hinge pins being snugly received in the yoke opening to define a fixed pivot axis, the hinge pins having confronting, oppositely angled surfaces to define an everwidening gap between the hinge pins, the surfaces being angled such as to provide a substantial bearing surface against an upper surface of the yoke opening in the closed position of the cap and a minimal interface thereagainst in the open position of the cap whereby to provide generally non-destructive assembly and removal of the cap to and from the closure while providing a generally secure hold on the closed cap.

36. The dropper bottle assembly of claim 35, the cap having a ledge spaced near the hinge pins and positioned to act as a fulcrum-like lever with the closure base upon pivoting the cap beyond the open position whereby to snap the cap from the closure.

37. The dropper bottle assembly of claim 36, the cap being sized to fit within the periphery of the closure base, the cap being relieved in an area adjacent the ledge to permit approximately 180° pivot of the cap between the closed and open position of the cap.

38. The dropper bottle assembly of claim 35, the angle of the hinge pin surfaces each being about 10° with respect to a plane through the longitudinal axis of the spout.

39. The dropper bottle assembly of claim 35 further comprising a pair of walls each supporting a respective hinge pin, the walls being deflectable to allow the hinge pins to be urged apart as the yoke is inserted therebetween and then urged back into the opening in the yoke, the pair of walls being spaced apart a distance such as to frictionally engage the yoke with the hinge pins in the opening thereof whereby to assist in holding the cap in any position between the open and closed positions.

40. The dropper bottle assembly of claim 1 wherein the cap is separate and non-integral the dispensing closure, the cap and closure being hinged by a hinge structure defining a fixed pivot axis about which the cap pivots between the open and closed positions.

41. The dropper bottle assembly of claim 1 wherein the bottle has an externally threaded neck portion and wherein the base of the dispensing closure includes an annular skirt with internal threads for engagement with the external threads of the bottle neck portion.

* * * * *

UNITED STATES PATENT AND TRADEMARK OFFICE

CERTIFICATE OF CORRECTION

PATENT NO. : 5,328,058

DATED : July 12, 1994

INVENTOR(S) : Richard A. Leoncavallo, Ravinder C. Mehra, and Gregory R. Phillips It is certified that error appears in the above-identified patent and that said Letters Patent is hereby corrected as shown below:

Column 8, line 21 "64" should read --164--.

Signed and Sealed this

Eighth Day of November, 1994

*Attest:*

*Attesting Officer*

BRUCE LEHMAN

*Commissioner of Patents and Trademarks*